US005464306A

United States Patent [19]

Cristiano

[11] Patent Number: 5,464,306

[45] Date of Patent: Nov. 7, 1995

[54] CONCRETE BARRIER JOINTS

[76] Inventor: Joseph Cristiano, 51 Marcella Crescent, Hamilton, Ontario, Canada, L8K 6E9

[21] Appl. No.: 291,841

[22] Filed: Aug. 17, 1994

[51] Int. Cl.[6] ..... E01F 15/00

[52] U.S. Cl. ..... 404/6; 256/13.1

[58] Field of Search ..... 404/6, 10, 12; 256/1, 13.1, 19, 65; 403/230, 231, 232, 311

[56] References Cited

U.S. PATENT DOCUMENTS

| | | | |
|---|---|---|---|
| 3,980,279 | 9/1976 | Bofinger | 256/13.1 |
| 4,773,629 | 9/1988 | Yadock | 256/13.1 |

FOREIGN PATENT DOCUMENTS

| | | |
|---|---|---|
| 1167306 | 5/1984 | Canada . |
| 2006477 | 7/1990 | Canada . |

OTHER PUBLICATIONS

Article: Portable Median Concrete Barriers: Structural Design and Dynamic Performance; Authors: Don L. Ivey, Hayes E. Ross et al.

Drawing Sheet: Ontario Provincial Standard Drawing; Title: Precast Concrete Barrier–Temporary Installation Detail; Drawing No.: OPSD–920.01 Date: Feb. 10, 1988.

Drawing Sheet: Ministry of Transportation–Ontario Drawing; No.: TMO–920.01 Title: Precast concrete Barrier–Temporary and Permanent Instllation Details Date: May 01, 1989.

*Primary Examiner*—Ramon S. Britts
*Assistant Examiner*—Pamela A. O'Connor
*Attorney, Agent, or Firm*—Patrick J. Hofbauer

[57] ABSTRACT

The present invention provides a female coupling member for use with a male coupling tenon having a free end, a narrow interconnecting shank and a root end all arranged in mutually axial relation with the shank interconnecting the free end and the root end. The female coupling member comprises two adjacent side walls having mutually opposed, convergent faces defining an opening therebetween, through which the shank of the male member extends with the free end positioned within the interior of the coupling member. Axial tensioning of the coupling urges the free end of the male member against the converging faces of the two side walls, in wedged interfering relation. Forces exerted on these faces by tensioning of the coupling are distributed from the female member into adjacent portions of the panel.

13 Claims, 2 Drawing Sheets

CONCRETE BARRIER JOINTS

FIELD OF THE INVENTION

The present invention relates to improvements in couplings, and especially in couplings useful in the interconnection of constructions such as precast concrete forms, including by way of example, construction median barriers.

BACKGROUND OF THE INVENTION

Construction median barriers are employed in many diverse applications. Perhaps most often, however, and as the name would suggest, these barriers are used for demarking the medians of roadways while road construction is under way.

A number of different types of couplings have been used in these applications in order to allow the coupled barriers to better withstand vehicular impacts, and to apportion impact energy between the vehicle, the impacted barrier panel and those panels to which it is connected. In order to function properly, these barriers must be coupled with one another in such a way as to safely communicate impact energies along the length of the coupled structure. Couplings have been assessed in terms of their resistance to the loading conditions, which describe the four major force components which may result from vehicular impact against the barrier.

The first loading condition involves the tensile forces that are applied through the connection along the common longitudinal axis of two longitudinally aligned, interconnected barrier panels. The second loading condition is a measure of the shear forces acting normally to the longitudinal axis and generally parallel to the ground. The third load relates to a rotational moment acting across the longitudinal axis and generally parallel to the ground. The fourth loading condition is in relation to a torsional moment acting around the longitudinal axis.

Two of the strongest coupling designs in use today are the so called New Jersey Welsback interlock connection and the slightly weaker New York "CI" interlock system. Both couplings include female members having a "C" shaped cross-section, formed by an opening along one side of what would otherwise be a generally rectangular cross-section. This opening is designed to accommodate the shank of a male member, such that the larger, free end of the male member is locatable within the interior of the "C" section, while the shank extends out through the above mentioned opening. In this way the male member is secured in interfitting relation within the female member.

In the case of the New York "CI" interlock system, barriers are made up of panels having two mutually opposed, female ends. Adjacent ends are secured to one another by driving a pin, having an "I" shaped cross-section between adjacent female ends of two panels aligned with the openings in the "C" sections in register with one another. The shank of the pin passes through the openings of the two female coupling members, with the larger free ends thereof then being secured against axial withdrawal by the narrowness of the opening. Although the system is relatively easy to install, and removal of individual panels is a straightforward operation that does not require moving any more than the panel in question, the three part system is inherently disadvantageous. This problem has been overcome in a design that has been adopted in Ontario, wherein each panel has both a male and a female end. In either case, the tensile forces applied in the axial direction, as mentioned above, act against little more than the remainder of the sides in which the opening was cut. As a consequence the resistance to such forces in the New York device, were found to be about half of the resistance of the Welsback device. In the latter, the 37 C" section is deeply recessed within the cement panel, so that the axial forces act against substantially more supporting material than is available in the case of the New York device. This deep recessing, and the requisite lengthening of the interfitting male member, may account for why testing has shown the Welsback device to have a some what lower resistance to shear stress than the New York device. In addition, the Welsback device employs a female member that is much more complex and more expensive to manufacture.

There remains a need for strong, simple and relatively inexpensive couplings, particularly in construction median barrier applications.

SUMMARY OF THE INVENTION

In accordance with one aspect of the present invention there is disclosed a coupling for use between two adjacent median barrier panels, each barrier panel having a longitudinally extending main body portion. The coupling comprises a male coupling tenon having a free end and a root end, and a longitudinally oriented shank interconnecting the free end and the root end, with the root end securely retained within the main body portion of one of the median barrier panels and the free end extending outwardly from an end face of the main body portion. There is a female coupling member positioned within the main body portion of the other of the median barrier panels adjacent a longitudinal end face thereof, the female coupling member defining a hollow, generally vertically oriented interior channel dimensioned to receive the free end of the male coupling therein in generally vertical sliding relation. The channel has a first pair of mutually adjacent side walls with respective mutually opposed convergent faces adapted to engage the free end of the male coupling tenon. The first pair of mutually adjacent side walls is oriented within the main body portion of the other median barrier so as to translate non-axially directed forces from the free end of the male coupling tenon into forces that are in substantial part directed axially along the length of the main body portion of the other of the median barrier panels. There is a generally vertically oriented slot in the channel that opens into the hollow interior thereof, the slot being adapted to receive the shank of the male coupling tenon in vertical sliding relation, and to preclude the passage of the free end of the male coupling tenon therethrough. An opening is located in the female coupling member, the opening being adapted to permit passage of the male coupling tenon into and out of the slot.

The present invention relates to couplings useful in cojoining objects including in particular, but without limiting the generality of the foregoing, structures such as precast walls, and especially barriers, such as for example construction median barriers.

In accordance with one aspect of the present invention, there is provided a female coupling member adapted to redirect forces, (especially for example those applied by axial tensioning across a coupling), into the panel in which the female coupling member is located.

Broadly speaking, the female member includes two adjacent side walls having mutually convergent faces adapted to wedgingly engage a portion of an interfitting male tenon therebetween. In this regard there is provided a female coupling member adapted to receive a free end of a male tenon in coupled relation between two adjacent female coupling member side walls presenting respective mutually opposed convergent faces for engaging the free end of the male member therebetween. Preferably, the female coupling member comprises at least four side walls enclosing the interior.

More particularly, one aspect the present invention provides a female coupling member for use with a male coupling tenon having a free end, a narrow interconnecting shank and a root end all arranged in mutually axial relation with the shank interconnecting the free end and the root end. The female coupling member comprises two adjacent side walls having mutually opposed, convergent faces. In one aspect these mutually opposed and convergent faces define an opening therebetween, through which the shank of the male member extends with the free end positioned within the interior of the coupling member. Axial tensioning of the coupling urges the free member against the converging faces of the two side walls, in wedged interfering relation. Forces exerted on these faces by tensioning of the coupling are distributed from the female member into adjacent portions of the panel.

Accordingly, there is provided a female coupling member for use with a male coupling tenon having a free end, a narrow interconnecting shank and a root end all arranged in mutually axial relation with said shank interconnecting said free end and said root end, which in turn is adapted to be secured to a first object. The female coupling member, at least in part defines a hollow interior internally of a second object between two adjacent, mutually transverse side walls having mutually convergent faces defining a first opening extending from the interior through an exterior surface of said second object. The first opening is adapted to accommodate the shank while restricting passage of the free end therethrough.

The female coupling member includes an at least one second opening from an exterior surface of the second object. The second opening is contiguous with the first and adapted to pass the free end through and into the interior.

In this arrangement the male coupling tenon is adapted to be coupled to the female coupling member, with the free end positioned within the interior and the shank extending through the first opening therein. The free end is wedgingly engaged in interfering relation with the faces of the side walls to thereby resist axial withdrawal of the male member from the female member through the first opening.

In a preferred aspect of the present invention, the female coupling member comprises an elongated rectangular body having a hollow interior with a generally rectangular cross-section defined between four side walls arranged in mutually opposed pairs. The first opening extends longitudinally along a corner of the rectangular body between two adjacent ones of the side walls. In one embodiment a first second opening is arranged at one end of the body, and a second, second opening is arranged at the opposite end.

As will be described in greater detail herein below, each of the mutually opposed pairs of side walls preferably comprises a first side wall and a mutually opposed side wall. The first side walls are adjacent one another, and each first side wall is narrower than its corresponding mutually opposed side wall. The first opening is thereby defined between the adjacent first side walls.

In addition, the use of the rectangular body involves a further aspect of the present invention, in which the free end of the male tenon is positionable between the two adjacent side walls farthest removed from the first opening. As will be described in greater detail hereinbelow, this arrangement has advantages in connection with the transmission of shearing forces applied across the coupling, and it is noted that these advantages do not depend on the interfering wall structures from which the above mentioned advantages relating to axial tension arise. Accordingly there is provided in another aspect of the present invention a female coupling member adapted to receive a free end of a male tenon in coupled relation therewith, between two adjacent side walls of said female coupling member, having mutually convergent faces for engaging said free member.

In one contemplated embodiment of the present invention there is provided a construction median barrier panel wherein the first side walls extend beyond respective mutually opposed end surfaces of a female panel to thereby define between respective pairs of first side walls and surfaces, grooves adapted to be received in interfitting relation with corresponding tongues of an adjacent male barrier panel. Preferably these grooves have a generally triangular cross-section, open at the base thereof and having apices formed at intersections between respective pairs of the first sides and surfaces.

The present invention extends to interconnecting couplings for releasably securing two objects, including the releasably mutually securable, male tenon and female coupling member described hereinabove.

In accordance with one embodiment the male tenon comprises a longitudinally extending rail, having an "I" shaped cross-section, with one end of the "I" being the free end, and the other end of the "I" being the root end, and with the narrow interconnecting portion of the "I" shape being the shank. In the interests of maximizing the resistance of the barrier to torque, the male tenon is preferably generally coextensive in length with the longitudinal extent of the elongated rectangular body.

In an especially preferred embodiment the present invention relates to a construction median barrier, and particularly one having the above described female coupling members arranged at one end thereof and the male tenon arranged at a mutually opposed end thereof. Naturally the invention includes coupled construction median barriers as described hereinabove. In addition, the present invention includes couplings as set forth herein, which are filled with compression resistant materials.

This use of compression resisting fill has broader application, and in this regard there is provided an interconnected coupling comprising coupled male and female members adapted to engage one another in interfitting relation with at least a portion of said female member engaging at least a portion of the male member in secured interfering relation interiorly of said female member, and wherein said interior is otherwise substantially filled with a granular, compression resistant fill. Preferably the fill comprises silica sand.

More particularly, the invention includes an interconnected coupling for releasably securing two objects, including a releasably mutually secured, male tenon and female coupling member pair comprising a male coupling tenon having a free end, a narrow interconnecting shank and a root end all arranged in mutually axial relation with the shank interconnecting the free end and the root end, which in turn is adapted to be secured to a first object. The female coupling member, at least in part, defines a substantially enclosed hollow interior internally of a second object between two adjacent, side walls defining a first opening extending from the interior through an exterior surface of the second object. The first opening accommodates the shank and restricts passage of the free end therethrough. The female coupling member includes an at least one second opening from an exterior surface of the second object, which is contiguous with the first and adapted to pass the free end through and into the interior. The male coupling tenon is coupled to the female coupling member, with the free end positioned within the interior and the shank extending through the first opening therein, to the free end in interfering relation with the side walls to thereby resist axial withdrawal of the male tenon from the female member through the first opening. The improvement herein relates to the inclusion of compression resistant granular fill within the interior.

In addition, there is also provided in accordance with another aspect of the present invention, couplings having open ended, hollow bodied brackets, especially tubes, affixed thereto to secure the reinforcing stirrups, typically in the form of round reinforcing bar stock, that are often used in connection with, for example, precast concrete construction median barriers. The advantages attendant the use of tubes in this application stem from the ease in which they are assembled and the fact that they avoid the problems with having to repair welding damage to seams between the galvanized couplings and stirrups. The ease of assembly aspects of these advantages are self evident on their face in light of the teachings of the present invention, and include not having to weld the metal coupling and stirrups in situ in the casting form. More importantly, however, by welding tubes onto the side of the coupling prior to galvanizing thereof, the need to repair the welding damage to the galvanizing with epoxy patching is eliminated. Epoxy patching is currently called for in numerous specifications for construction median barriers so that the integrity of the corrosion protection barrier is maintained intact. Epoxy patching is labour intensive, costly and delays the casting of the barrier.

Accordingly there is provided a galvanized coupling member adapted to be secured to reinforcing stirrups, wherein open-ended hollow brackets adapted to receive the stirrups in interfitting relation internally thereof, are welded to the coupling member prior to galvanizing. In a preferred aspect of this invention, the couplings are the male tenon and female coupling members set forth hereinabove.

DETAILED DESCRIPTION OF A PREFERRED EMBODIMENT

Introduction to the Drawings

In connection with the following detailed description of a preferred embodiment of the present invention, reference will be made to the appended drawings, of which:

Figure 1:
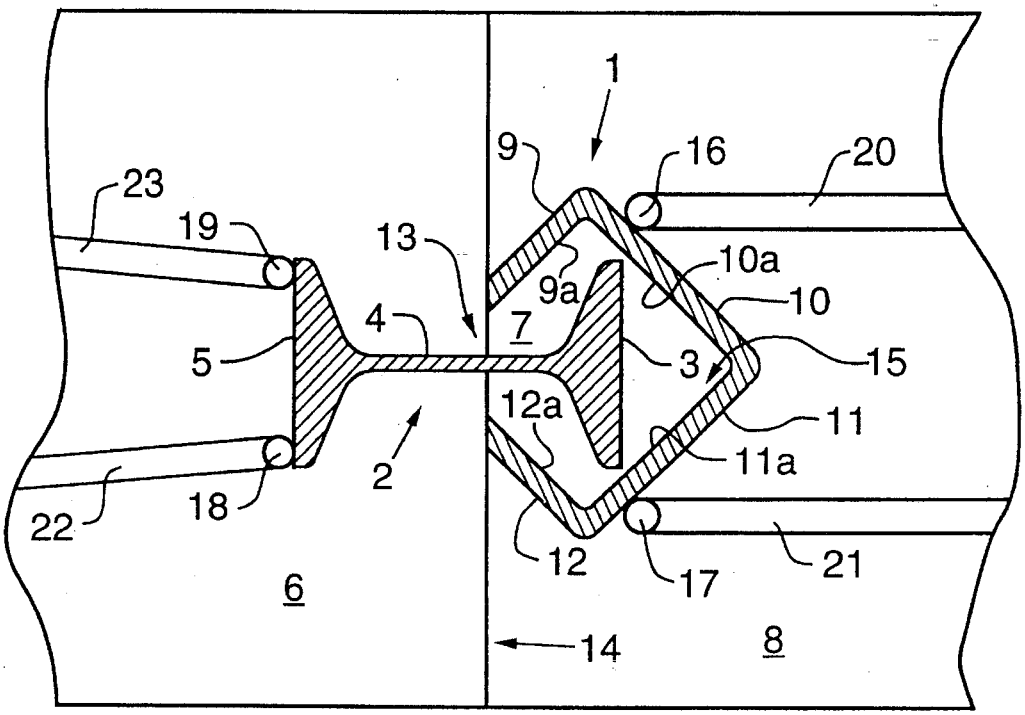
FIG. 1 depicts a cross-sectional, plan view taken through a preferred coupling of the present invention, shown in situ interconnecting two panels of a construction median barrier.
Figure 2:
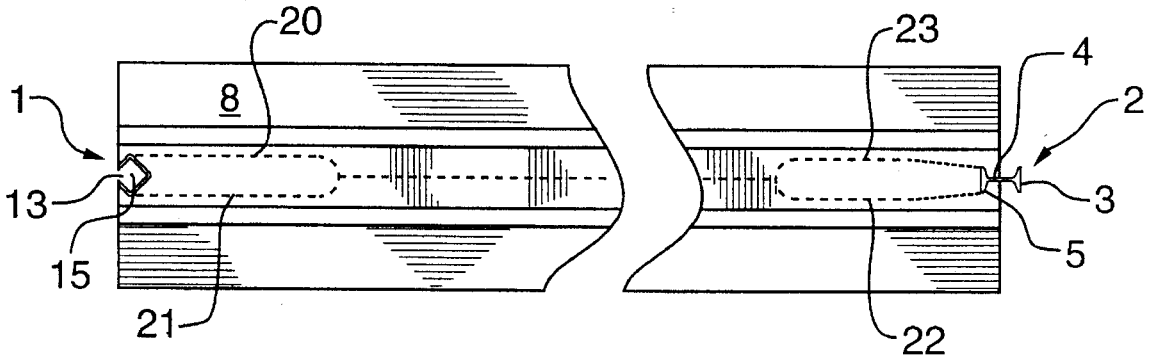
FIG. 2 illustrates a cross-sectional plan view of a single, preferred panel of the present invention.
Figure 3:
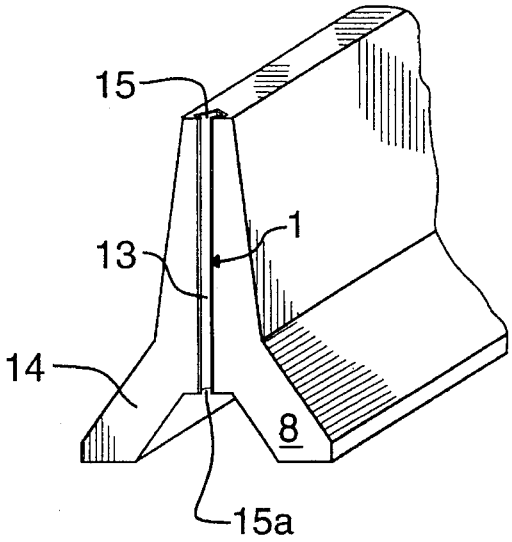
FIG. 3 represents an elevated end view of the panel depicted in FIG. 2, as seen from the end bearing the female coupling member.
Figure 4:
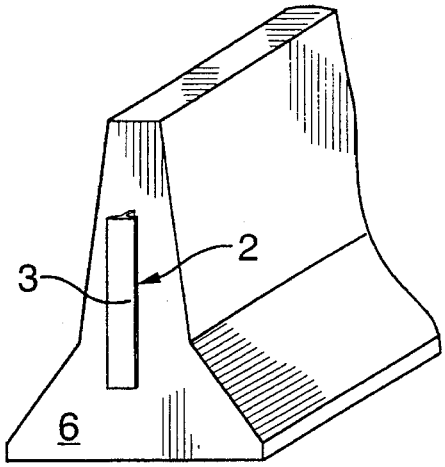
FIG. 4 is an elevated view of the other end of the same panel that is depicted in FIG. 3, showing the male tenon extending therefrom; and, FIG. 5 depicts an alternative embodiment of one aspect of the present invention.

Referring now to the drawings in general there is shown the coupling of the present invention shown installed in two adjacent median barrier panels 6, 8. The coupling includes a female coupling member 1, for use with a male coupling tenon 2, having a free end 3, a narrow longitudinally oriented shank 4, and a root end 5, all arranged in mutually axial relation with the shank 4, interconnecting the free end 3 and the root end 4. The root end 4 is securely retained within the main body portion of a pre-cast concrete median barrier panel 6. The free end 3 extends outwardly from an end face of the main body portion of the median barrier panel 6. As illustrated, the male tenon 2 comprises a longitudinally extending rail, having an "I" shaped cross-section, with one end of the "I" being the free end 3, and the other end of the "I" being the root end 5, and with the narrow interconnecting portion of the "I" shape being the shank 4. The male tenon 2 is generally coextensive in length with the longitudinal extent of the elongated rectangular body of the female coupling member 1, as mentioned hereinbelow. Note that the female coupling member 1 is arranged relative to the male tenon 2 when the latter is inserted therein, such that ample lateral clearance is provided to permit the free end 3 to be inserted without necessarily requiring the ends thereof to be tapered to guide the tenon 2 into the confines of the interior The female coupling member 1 defines a hollow generally vertically oriented interior channel 7, positioned within the main body portion of a pre-cast concrete median barrier panel 8.

In the preferred embodiment, the female coupling member 1 is a separate and distinct member, preferably made from suitably hard galvanized steel. The female coupling member 1, in accordance with this embodiment of the present invention, comprises an elongated rectangular body with a generally rectangular cross-section defined between four side walls, 9, 10, 11, and 12, arranged in mutually opposed pairs, (eg. side 9 and side 11 are arranged as a mutually opposed pair of sides). In this way, interior 7 is defined between the two adjacent, mutually transverse side walls, 9 and 12, having mutually convergent faces, **9*a* and 12*a* respectively, defining a first opening 13 in the form of an elongated slot, extending longitudinally along a corner of the rectangle between the two adjacent side walls 9 and 12 from the interior 7 through an exterior surface 14 of the barrier panel 8. This first opening 13, extends longitudinally along a corner of the rectangular body between the two adjacent side walls, 9 and 12. This first opening 13, is adapted to accommodate the shank 4, but to restrict passage of the free end 3, therethrough. Note that each of the mutually opposed pairs of side walls, (i.e. 9 and 11) comprise a first side wall (i.e. 9) and a mutually opposed side wall (i.e. 11), with the two first side walls (i.e. 9 and 12) being mutually adjacent one another, and each of the two first side walls being narrower than its corresponding mutually opposed side walls (i.e. 11 and 10 respectively), so that the first opening 13 is arranged between the adjacent first side walls, 9 and 12**.

The female coupling member 1 also includes a first second opening 15, from another exterior surface of the panel 8. The first second opening 15, arranged at one end of the hollow rectangular body, is contiguous with the first opening 13 and adapted to pass the free end 3 through and into the interior 7, so as to permit passage of the male coupling tenon 2 into and out of the first opening 13. A second, second opening, **15*a***, is arranged at the opposite end of the hollow rectangular body, and in conjunction with the first second opening, allows individual panels to be lifted free from between two adjacent panels.

The interior channel 7 is dimensioned so as to receive the free end 3 of the male coupling tenon 2 in generally vertical sliding relation therein. In order to couple two adjacent barrier panels together, one barrier panel is lifted, usually by way of a crane, and lowered such that the male coupling tenon 2 slides vertically through the opening 15 and into the hollow interior channel 7 in the female coupling member 1 in the barrier panel that is already in place. Alternatively, if appropriate, the barrier panel is lowered such that the female coupling member 1 slides over the male coupling tenon of the barrier panel already in place.

The interior channel 7 has a first pair of mutually adjacent side walls 10, 11 with respective mutually opposed convergent faces 10*a*, 11*a*, which opposed convergent faces are adapted to engage the free end 3 of the male coupling tenon 2. There is also a second pair of mutually adjacent side walls 9, 12 with respective mutually opposed convergent faces 9*a*, 12*a*. The mutually adjacent side walls 9, 12 define the generally vertically oriented slot, which is in the form of first opening 13.

As is shown, particularly in FIG. 1, the male coupling tenon 2 is adapted to be coupled to the female coupling member 1, with said free end 3 positioned within the interior 7 and the shank 4 extending through the first opening 13 therein, to wedgingly engage the free end 3 in wedged interfering relation with faces 9*a* and 12*a*, to thereby resist axial withdrawal of the male tenon 2 from the female member 1, through the first opening, 13. The free end 3 of the male coupling tenon 2 in contact with faces 10*a* and 11*a*, and is closely positioned relative to the faces 9*a* and 12*a*, and could instead be in contact therewith. The shear forces across the coupling can cause the edges of the free end 3 to impart forces against one of these faces, thereby translating some of the shear forces into axial forces, which take better advantage of the weight of the panels to resist movement. Notably, these panels in general rely on mass and sliding friction for translational stability, since mechanical attachment to the ground is seldom provided for, except possibly in the case to panels specially adapted for use at the end of an assembled barrier. The resistance to lateral movement can therefore be quite significant.

In use, the two barrier panels 6, 8 are coupled together such that the end corners of the free end 3 are in contact with the respective opposed convergent faces 10*a* and 11*a* of the first pair of mutually adjacent side walls 10, 11. Since these faces 10*a*, 11*a* are symmetrically located in the main body portion of the barrier panel 8, placing both of the end corners of the free end 3 against both of the faces 10*a*, 11*a*, causes the two barrier 6, 8 to be laterally aligned, as can be seen in FIG. 1. Such lateral alignment is highly desirable and cannot be easily accomplished with barrier panels having prior art couplings.

In some applications the interior 7 is filled, once the male tenon 2 is positioned within the interior 7, with compression resisting fill material. This helps to secure the tenon 1 in place, and is generally only employed in fixed applications, although the use of fill is not necessarily so restricted.

Also depicted are open ended tubes 16, 17, 18 and 19, which are secured to respective ones of the male tenon 2 and the female coupling member 1, and which serve as hollow brackets adapted to receive the stirrups 20, 21, 22 and 23, respectively, in interfitting relation internally of the hollow defined by the bracket. Tubes 16, 17, 18 and 19 were welded to the coupling members 1 and 2, prior to galvanizing of the resulting assembly. As has already been mentioned, this has significant benefits in the manufacture of barrier panels and other similar reinforced castings, in general.

Figure 5:
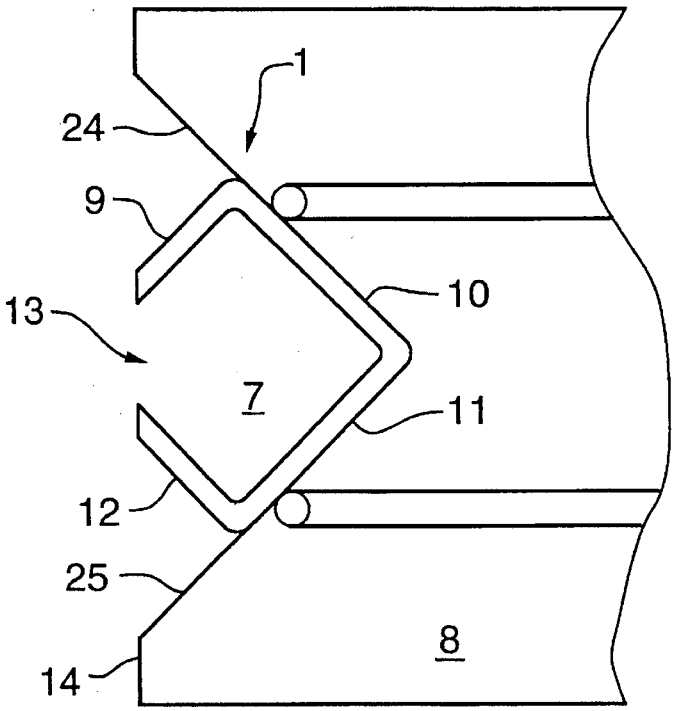

Referring now to FIG. 5 of the drawings there is shown an alternative embodiment of one aspect of the present invention, namely a female coupling of the present invention positioned in situ at a female end of a construction median barrier panel. In this installation, sides 9 and 12 of female coupling 1 extend outwardly beyond modified end 14 thereby forming between those sides and respective mutually opposed surfaces, 24 and 25, of end 14, two generally parallel grooves in end 14 running the length of female coupling member 1. This arrangement does away with portions of end 14 which are otherwise susceptible to damage over time and abuse of the barrier. Moreover, it is contemplated that corresponding modifications to an interfitting end on a coupled male barrier may improve coupling characteristics between the two barriers.

I claim:

1. A coupling for use between two adjacent median barrier panels, each barrier panel having a longitudinally extending main body portion, said coupling comprising:

a male coupling tenon having a free end and a root end, and a longitudinally oriented shank interconnecting said free end and said root end, with said root end securely retained within the main body portion of one of said median barrier panels and said free end extending outwardly from an end face of said main body portion;

a female coupling member positioned within the main body portion of the other of said median barrier panels adjacent a longitudinal end face thereof, said female coupling member defining a hollow, generally vertically oriented interior channel dimensioned to receive the free end of the male coupling therein in generally vertical sliding relation;

said channel having a first pair of mutually adjacent side walls with respective mutually opposed convergent faces adapted to engage the free end of said male coupling tenon, said first pair of mutually adjacent side walls being oriented within the main body portion of said other median barrier so as to translate non-axially directed forces from the free end of said male coupling tenon into forces that are in substantial part directed axially along the length of said main body portion of the other of said median barrier panels;

a generally vertically oriented slot in said channel opening into said hollow interior thereof, said slot being adapted to receive said shank of said male coupling tenon in vertical sliding relation, and to preclude the passage of said free end of said male coupling tenon therethrough;

an opening in said female coupling member, said opening being adapted to permit passage of said male coupling tenon into and out of said slot.

2. The coupling of claim 1, further comprising a second pair of mutually adjacent side walls with respective mutually opposed convergent faces defining said generally vertically oriented slot.

3. The coupling of claim 1, wherein said female coupling member is of generally rectangular cross-section defined between four side walls arranged in mutually opposed pairs, with the slot extending longitudinally along a corner of the rectangle between two adjacent ones of the side walls.

4. The coupling of claim 1, wherein said channel is of generally triangular horizontal cross-section, with said triangle being open at a portion of its base to define said slot.

5. The coupling of claim 1, wherein said opening is positioned above the vertical level of said slot.

6. The coupling of claim 1, wherein said female coupling member comprises an elongated rectangular channel having a hollow interior with a generally rectangular cross-section defined between four side walls arranged in mutually opposed pairs, and wherein said slot extends longitudinally along a corner of said rectangular body between two adjacent ones of said side walls.

7. The coupling of claim 6, wherein each of said mutually opposed pairs of side walls comprises a first side wall and a mutually opposed side wall, with said first side walls being mutually adjacent one another, and each said first side wall being narrower than its corresponding mutually opposed side wall, and wherein said slot is arranged between said adjacent side walls.

8. The coupling of claim 1, wherein said male coupling tenon is adapted to be coupled to said female coupling member, with said free end positioned within said interior and said shank extending through said slot therein, to wedgingly engage said free end in wedged interfering relation with the respective of said side walls to thereby resist axial withdrawal of said male member from said female member through said first opening.

9. The coupling of claim 1, wherein the male tenon comprises a longitudinally extending rail, having an "I" shaped cross-section, with one end of the "I" being the free end, and the other end of the "I" being the root end, and with the narrow interconnecting portion of the "I" shape being the shank.

10. The coupling of claim 1, wherein the male tenon is generally coextensive in length with the longitudinal extent of said channel.

11. The coupling of claim 1, wherein said interior is filled, with the male tenon positioned in said interior, with compression resisting fill material.

12. The coupling of claim 11, wherein said fill material comprises silica sand.

13. The coupling of claim 1, wherein said female coupling member is adapted to be secured to reinforcing stirrups, wherein open-ended hollow brackets adapted to receive said stirrups in interfitting relation internally thereof, are welded to the female coupling member prior to galvanizing of the resulting assembly.

* * * * *